US005354249A

United States Patent [19]

Raley

[11] Patent Number: 5,354,249

[45] Date of Patent: Oct. 11, 1994

[54] EXERCISE APPARATUS

[76] Inventor: Teresa M. Raley, 7 E. First St., Cumberland, Md. 21502

[21] Appl. No.: 152,695

[22] Filed: Nov. 16, 1993

[51] Int. Cl.[5] ..... A63B 22/06; A63B 69/16

[52] U.S. Cl. ..... 482/57; 482/62

[58] Field of Search ..... 482/57, 62, 51, 37, 482/38, 60, 148, 908

[56] References Cited

U.S. PATENT DOCUMENTS

| | | | |
|---|---|---|---|
| 1,386,206 | 8/1921 | Samuelson . | |
| 2,416,471 | 2/1947 | Chappedelaine . | |
| 3,056,603 | 10/1962 | Levine et al. . | |
| 3,058,742 | 10/1962 | Jaffe . | |
| 3,526,399 | 9/1970 | Hjelte . | |
| 3,731,921 | 5/1973 | Andrews | 482/62 |
| 3,874,657 | 4/1975 | Niebojewski | 482/62 |
| 4,169,591 | 10/1979 | Douglas | 482/62 |
| 4,618,141 | 10/1986 | Ashworth . | |
| 4,621,805 | 11/1986 | Chen | 482/57 |

FOREIGN PATENT DOCUMENTS 3046117 7/1982 Fed. Rep. of Germany .

*Primary Examiner*—Stephen R. Crow
*Attorney, Agent, or Firm*—Richard C. Litman

[57] ABSTRACT

An exercise apparatus is disclosed which utilizes a crank shaft having two substantially U-shaped throw members. The orientation of each throw member is adjustable with respect to the other throw member, therefore allowing the crank shaft to assume two different configurations. The first setting results when one of the U-shaped throw members is secured in a position one hundred and eighty degrees offset with respect to the other gripping member. This configuration enables a motion similar to that of pedaling a bicycle as the user's arms (or legs) flex at different times. The second setting is obtained when both throw members are secured with their U-shapes facing the same direction. When so configured, the user's arms (or legs) flex simultaneously as both arms (or legs) push and pull at the same time. Each throw member is separable from each other and optionally includes weights positioned along its length. The weights change the resistance of the crank shaft to turning, and hence, the effort which the user must exert.

2 Claims, 4 Drawing Sheets

EXERCISE APPARATUS

BACKGROUND OF THE INVENTION

1. Field of the Invention

The present invention relates to an exercise apparatus, and more particularly an exercise apparatus having a hand crank shaft with two substantially U-shaped throw members. The orientation of each throw member with respect to the other throw member adjusts between two distinct exercise positions.

2. Description of the Prior Art

Exercise devices employing the use of a rotatable crank shaft are well known in the prior art. These devices are utilized when the operator manually rotates the crank shaft about its longitudinal axis. Factors affecting the feel and performance of these devices include the shape of the crank shaft, the resistance (if any) applied to oppose the rotating motion of the crank shaft, and the flexibility in the height by which the crank shaft may be positioned in relation to the crank shaft support system.

Frequently, the configuration of the rotatable crank shaft comprises two substantially U-shaped gripping members fixedly attached with one U-shaped member inverted with respect to the other. The operator grips each U-shaped member and rotates the crank shaft in a similar manner to pedaling a bicycle. Examples of this type of arrangment are U.S. Pat. No. 1,386,206 issued to Otto Ludvig Samuelson on Aug. 2, 1921, U.S. Pat. No. 2,416,471 issued to Jean Olivier de Chappedelaine on Feb. 25, 1947, U.S. Pat. No. 3,056,603 issued to Sidney Levine et al. on Oct. 2, 1962, U.S. Pat. No. 3,058,742 issued to Sarah Jaffe on Oct. 16, 1962, U.S. Pat. No. 3,526,399 issued to George Hjelte on Sep. 1, 1970, and German Pat. No. 3046117 issued to Wolfgang Juckel on Jul. 22, 1982.

In order to increase the exertion required in rotating the crank shaft, resistance is often applied opposing the free rotation of the crank shaft. One method of employing this resistance is to frictionally restrain the ends of the crank shaft attached to the support system. This is seen in both the Samuelson patent and the Jaffe patent, which disclose mechanisms to selectively increase or decrease the level of resistance.

The prior art references also disclose mechanisms to adjust the height of the crank shaft in relation to the crank support system. One example of such a mechanism is the Jaffe patent, which describes an adjustable exercise apparatus for use in the sitting or lying position. The variation of the height of the crank shaft results from attaching a spanning member to a rising member extending from a stationary frame. A retractile eye is fixed on the rising member to receive one of a plurality of openings along the length of the spanning member. A pin is placed through the retractile eye after it has received the spanning member. This secures the spanning member to the rising member and therefore establishes the crank shaft at a selected height.

None of the above inventions and patents, taken either singly or in combination, is seen to describe the instant invention as claimed.

SUMMARY OF THE INVENTION

The present invention is an exercise apparatus with a crank shaft having two substantially U-shaped throw members. The orientation of each throw member is adjustable with respect to the other throw member, therefore allowing the crank shaft to be alternated between two different configurations. The first configuration is provided when one of the U-shaped throw members is secured in an inverted position with respect to the other throw member. The second setting results when both throw members are secured with their U-shapes facing the same direction. Each throw member is separable from each other and is optionally furnished with weights positioned along its diameter.

The two configurations of the crank shaft allow the user to exercise at different levels of exertion. When the U-shaped throw members are in the inverted position, the user has one hand (or leg) pushing on the crank shaft while the other hand (or leg) pulls on the crank shaft. This pushing and pulling motion alternate as the crank shaft is rotated about its axis. This is similar to the motion required to pedal a bicycle. When the U-shaped throw members are secured in the same direction, the user's hands or legs are not alternating, but rather push and pull in the same direction as the crank shaft is rotated about its axis. Each configuration strengthens and tones different muscle groups. Additionally, weights can be added to increase the resistance required to rotate the crank shaft.

Accordingly, it is a principal object of the invention to provide an improved exercise device implementing a rotatable crank shaft with two axially displaced throw members adjustable between two exercising positions.

It is another object of the invention to provide an improved exercise device with a rotatable crank shaft capable of receiving weights attached thereto for alternating resistance characteristics.

It is a further object of the invention to provide an improved exercise device which permits the user to exercise in the standing, sitting, or lying positions.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
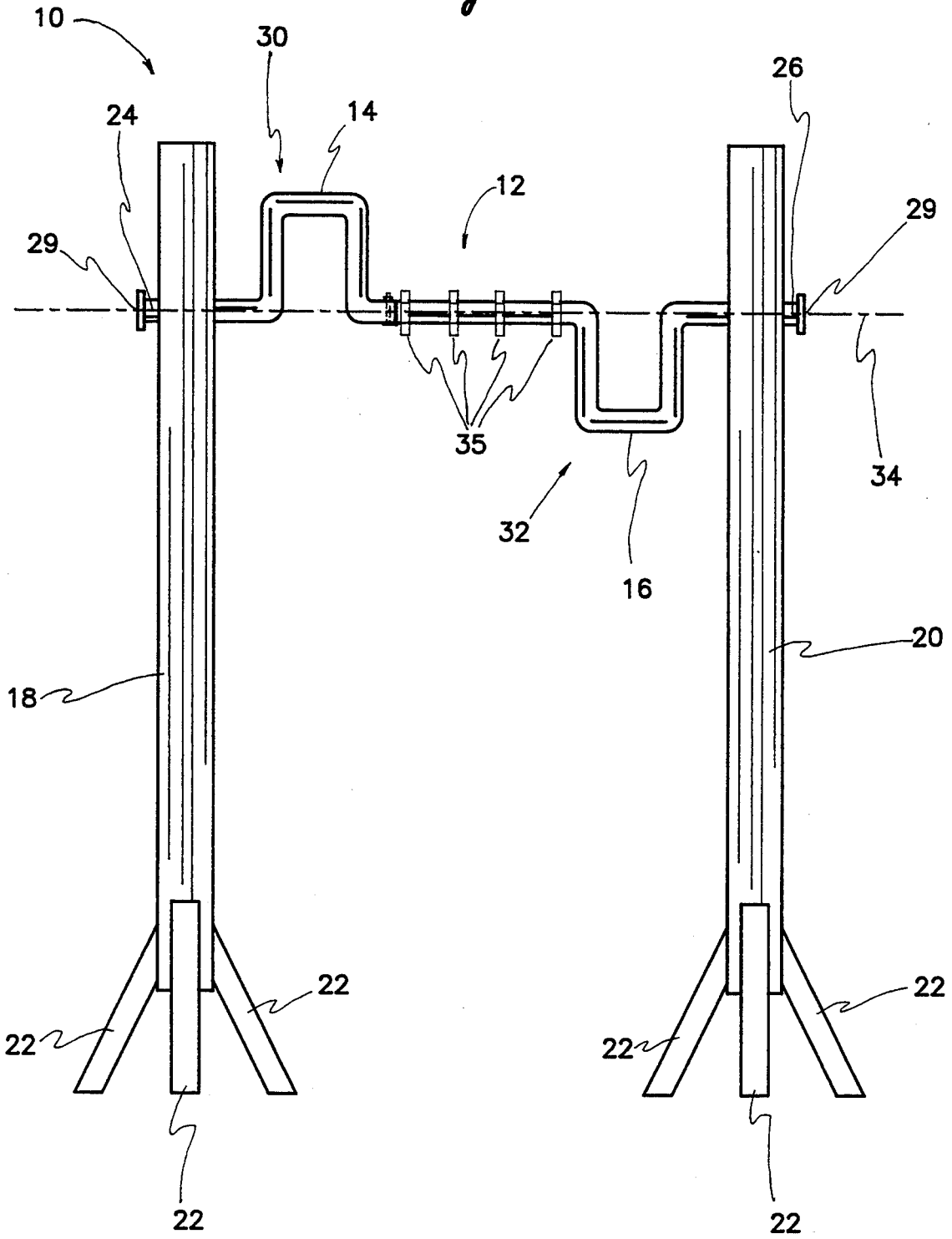
FIG. 1 is a front elevational view of the exercise apparatus with throw members secured on opposed sides of the longitudinal crank shaft axis.
Figure 2:
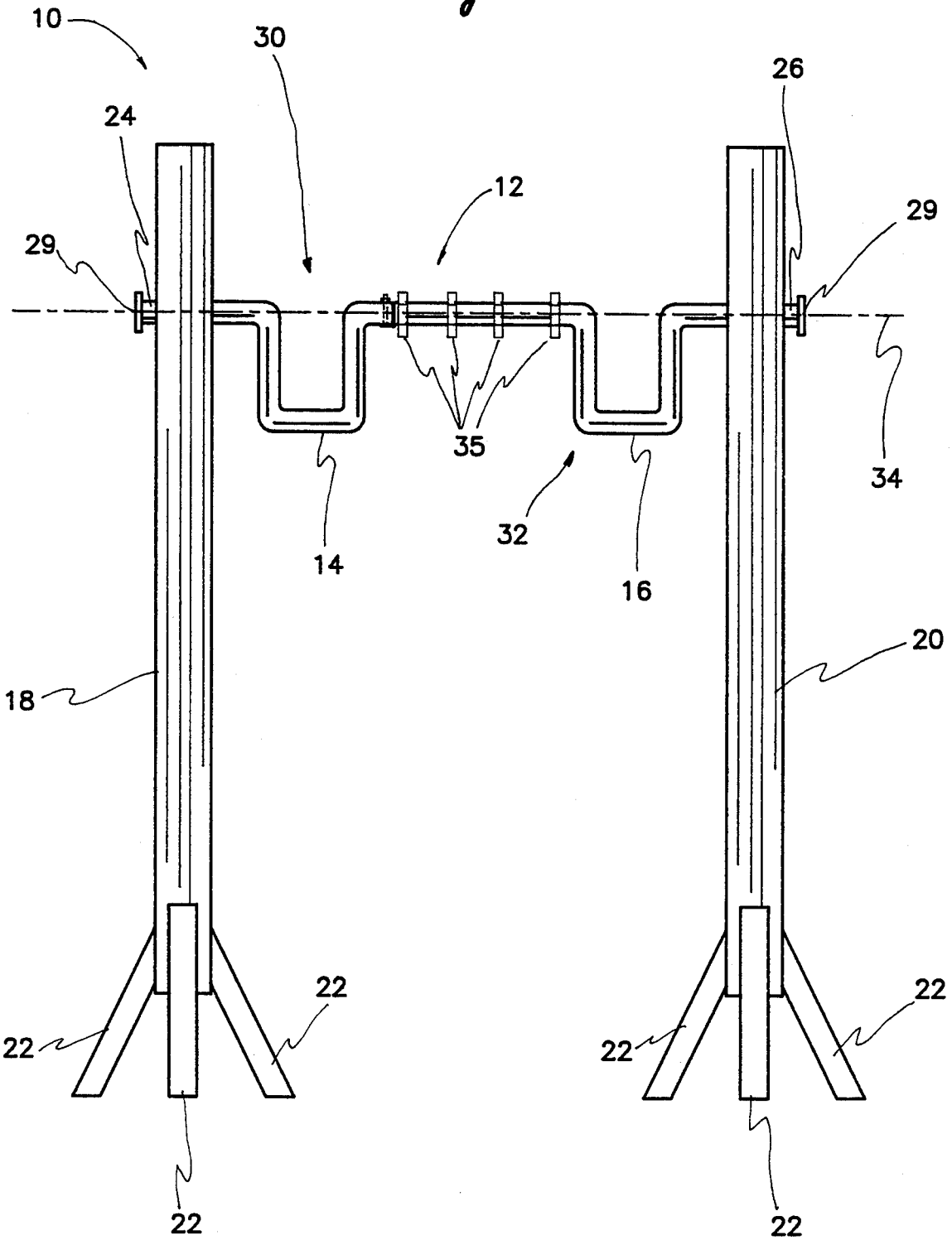
FIG. 2 is a front elevational view of the exercise apparatus with throw members secured on the same side of the longitudinal crank shaft axis.

Referring now to the drawings, FIGS. 1 and 2 illustrate an exercise apparatus 10 with its crank shaft 12. Exercise apparatus 10 is used by grasping handles 14 and 16 and manually rotating crank shaft 12. This rotation can be achieved by using either the hands or the feet to rotate crank shaft 12. A support frame maintains crank shaft 12 at a selected height above the ground. In the preferred embodiment, this support frame comprises support members 18 and 20 stabilized by support legs 22. Although the preferred embodiment utilizes support legs 22, other appropriate stabilizing methods, such as a concrete base, may be employed. Additionally, the apparatus 10 may be placed on any environmental surface, such being intended to include a floor, ground, or any other appropriate structure.

Figure 3:
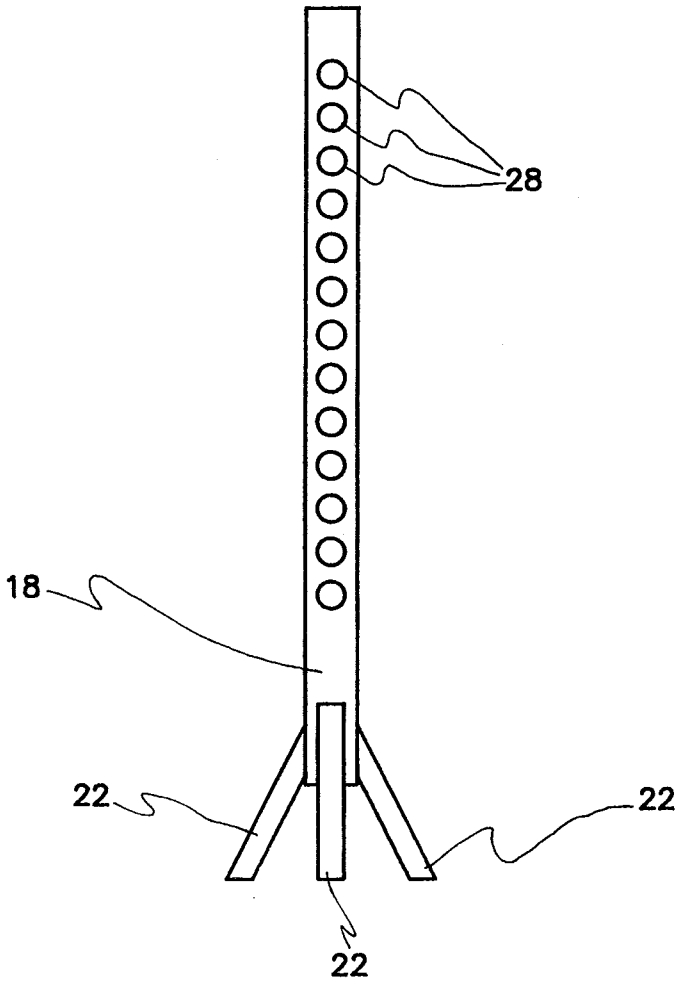
FIG. 3 is a side elevational view of one support member.

Crank shaft 12 has ends 24 and 26 rotatably journaled through and extending from support members 18 and 20 respectively. As depicted in FIG. 3, a plurality of holes 28 is arranged along the lengths support members 18 and 20. These holes 28 selectively receive ends 24 and 26 thereby allowing the height of crank shaft 12 to be adjusted with respect to support members 18 and 20. This height adjustment allows for flexibility of exercise apparatus 10 as it may be used in the standing, sitting, or lying positions. To insure that crank shaft ends 24 and 26 remain within holes 28 during exercise, ends 24 and 26 are fitted with respective retaining caps 29, whose outer diameter is greater than the diameter of holes 28.

Figure 4:
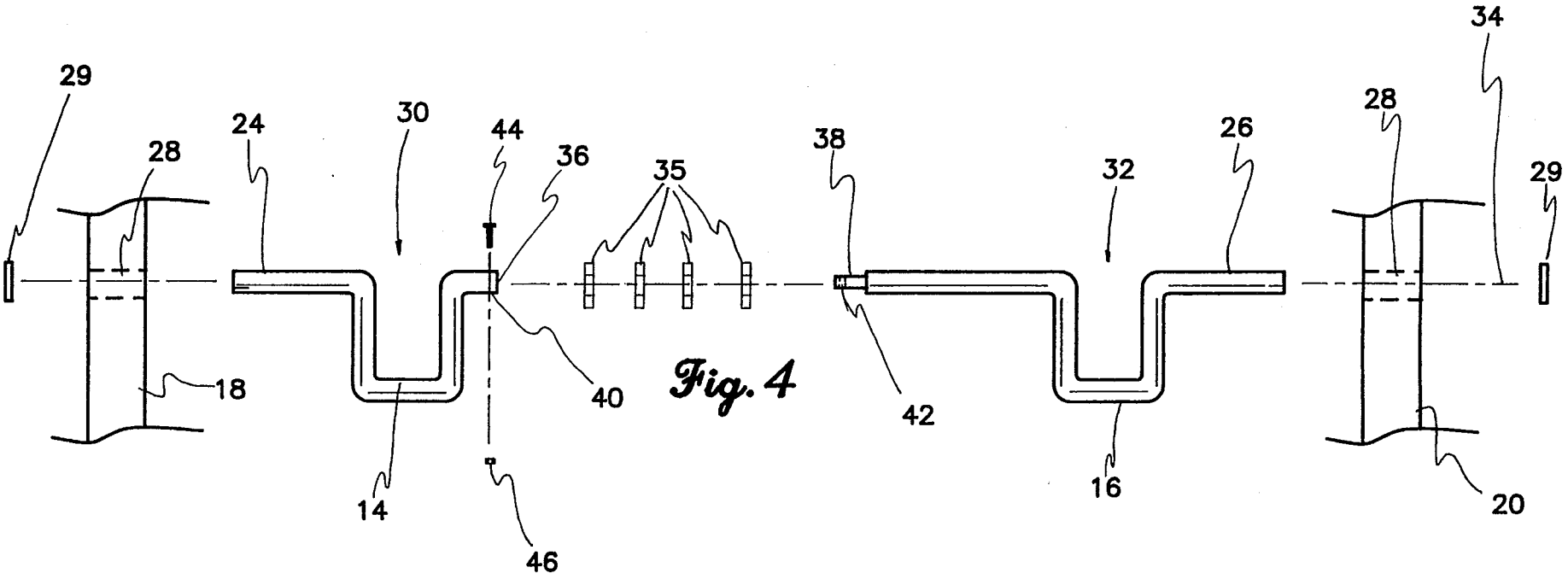
FIG. 4 is an expanded, fragmentary, front detail view of the crank shaft and its attachments.

Crank shaft 12 is essentially comprised of two throw members 30 and 32 radially displaced from longitudinal axis 34 to form gripping handles 14 and 16. As is readily seen in FIG. 4, throw member 30 is separably attached from throw member 32. When throw members 30 and 32 are separated, a plurality of weights 35 may be added along the length of crank shaft 12. Crank shaft 12 may also be configured to include other separable regions therefore permitting great flexibility in the locations where weights may be added. Additionally, weights may be added to ends 24 and 26.

The shape of weights 35 is such that they have an inner circular shape of a diameter allowing the weight to be removably secured about crank shaft 12. This could be accomplished with a friction fit or through the use of a threaded engagement (not shown).

Throw member ends 36 and 38 are arranged in a telescoping relationship where receiving holes 40 and 42 align to receive bolt 44. Bolt 44 is secured by nut 46 and opposes the relative rotation of throw members 30 and 32 about axis 34, thereby securing throw members 30 and 32 on either the same side of axis 34 or on opposite sides of axis 34. FIG. 1 represents crank shaft 12 with throw members 30 and 32 secured on opposite sides of axis 34. The motion required to rotate crank shaft 12, when in this configuration, is similar to that required to rotate bicycle pedals. One hand (or leg) pushes while the other hand (or leg) pulls. Alternatively, FIG. 2 represents crank shaft 12 with throw members 30 and 32 secured on the same side of axis 34. Here, the user's hands (or legs) work simultaneously as they push and pull to rotate crank shaft 12.

It is to be understood that the present invention is not limited to the sole embodiment described above, but encompasses any and all embodiments within the scope of the following claims.

I claim:

1. An exercise device comprising:

two support members engaging an environmental surface, each one of said support members defining a plurality of holes therein;

a crank member having an axial shaft with two ends removably extending through two of said plurality of holes, whereby the height of said crank member with respect to said support members is adjustable, said two ends each having a retaining cap;

two throw members radially displaced from said axial shaft, said throw members being separably attached to and linearly disposed along said axial shaft of said crank member, said throw members further including telescoping members, each including an alignable hole; and a nut and bolt assembly insertable into said alignable holes, said bolt preventing relative rotation of said throw members about said axial shaft of said crank member, whereby said throw members are securable selectively on the same side of said axial shaft and on opposite sides of said axial shaft.

2. The exercise device according to claim 8 wherein said crank member further comprises removable weight means attached about the axis thereof, for altering the effort required to rotate said crank member journaled in said support members.

* * * * *